US007310871B2

(12) United States Patent
Kuroiwa et al.

(10) Patent No.: US 7,310,871 B2
(45) Date of Patent: Dec. 25, 2007

(54) SURFACE-MOUNTING COIL COMPONENT AND METHOD OF PRODUCING THE SAME

(75) Inventors: Katsutoshi Kuroiwa, Gunma (JP); Koichi Iguchi, Gunma (JP); Tomoo Kashiwa, Gunma (JP); Masaki Okamoto, Gunma (JP); Takahiro Samata, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 11/788,588

(22) Filed: Apr. 19, 2007

(65) Prior Publication Data

US 2007/0193022 A1 Aug. 23, 2007

Related U.S. Application Data

(62) Division of application No. 11/022,110, filed on Dec. 22, 2004, now Pat. No. 7,209,022.

(30) Foreign Application Priority Data

Dec. 22, 2003 (JP) ..... 2003-425264
Jul. 16, 2004 (JP) ..... 2004-209692

(51) Int. Cl.
*H01F 7/06* (2006.01)
*H01F 5/00* (2006.01)

(52) U.S. Cl. ..... 29/605; 336/200

(58) Field of Classification Search ..... 336/65, 336/83, 90–96, 192, 200, 232; 29/602.1, 29/605–609

See application file for complete search history.

(56) References Cited

U.S. PATENT DOCUMENTS 5,457,872 A * 10/1995 Sakata et al. ..... 29/605
5,680,087 A 10/1997 Sakata et al.
6,154,112 A 11/2000 Aoba et al.
6,348,850 B1 2/2002 Kimura et al.
6,393,691 B1 5/2002 Ogawa et al.
6,449,830 B1 * 9/2002 Amada et al. ..... 29/605
6,856,229 B2 * 2/2005 Ogawa et al. ..... 336/200
6,882,261 B2 * 4/2005 Moro et al. ..... 336/200
7,215,232 B2 * 5/2007 Aoki et al. ..... 336/83
2003/0105240 A1 6/2003 Hikosaka et al.
2004/0046626 A1 3/2004 Nakata et al.

FOREIGN PATENT DOCUMENTS

JP 8-300349 11/1996

* cited by examiner

*Primary Examiner*—Tuyen T. Nguyen
(74) *Attorney, Agent, or Firm*—Knobbe Martens Olson & Bear LLP

(57) ABSTRACT

A surface-mounting choke coil has a resin coating material with magnetic powder which is filled a space between the upper flange and the lower flange of a drum-type ferrite core, while covering the circumferential of the winding. The resin coating material with magnetic powder has a glass transition temperature Tg of about −20° C. or lower, more preferably about −50° C. or lower in a course of transferring from a glass state to a rubber state during changing of shear modulus with respect to temperature as a physical property when hardening, and the thickness of the upper flange of the drum-type ferrite core is about 0.35 mm or less, and a value of a ratio L2/L1 of an outer diameter L2 of the upper flange to a diameter L1 of the winding core of the drum-type ferrite core is about 1.9 or more.

7 Claims, 5 Drawing Sheets

SURFACE-MOUNTING COIL COMPONENT AND METHOD OF PRODUCING THE SAME

CROSS-REFERENCE TO RELATED APPLICATIONS

This application is a divisional of U.S. application Ser. No. 11/022,110, filed on Dec. 22, 2004, now U.S. Pat. No. 7,209,022. The Ser. No. 11/022,110 application is hereby incorporated by reference in its entirety.

BACKGROUND OF THE INVENTION

1. Field of the Invention

The present invention relates to a surface-mounting coil component applied, for example, to coils for heightening and lowering voltage of DC/DC source of portable electronic devices.

2. Description of the Related Art

A current corresponding coil (such as choke coil) for application to DC/DC power source of the portable electronic devices such as portable telephones or digital still cameras has been in particular demanded to have a surface-mounting coil component of low height in an external dimension while securing a desired inductor characteristic.

The portable electronic device is usually carried around and subjected to severe changing of circumstances in temperatures, and therefore a surface-mounting coil component mounted on a board housed inside of the portable electronic device is imposed heat cycle tests of 10 cycles at −25° C. to +85° C., or most severely, 10 cycles at −40° C. to +85° C.

As representative structures of the surface-mounting coil component used to the existing portable electronic machinery, a sleeve core is covered on the outer circumference of the drum-type ferrite core to which the winding is wound around the winding core portion connecting the upper flange and the lower flange, the sleeve core is fixed by an adhesive with terminal electrodes of a metal frame, and both ends of the winding are fixedly bound and soldered on the terminal electrode (not shown).

Further, as other existing surface-mounting coil components, there are the surface-mounting coil components of a structure solely composed of the drum-type ferrite core wherein the winding is wound around the winding core and both ends of the winding are conductively connected to plane external electrodes directly attached to the core, or of a structure of filling an resin coating material to cover around the winding between both flanges of the drum-type ferrite core.

As the structure of the conventional surface-mounting coil component, the under mentioned [Patent Literature 1] describes the structure of a coil part using the drum-type ferrite core as shown in FIG. 6, a perspective view from the bottom side.

That is, the coil part 10 has the structure comprising the drum-type ferrite core 8 that is composed of the upper flange 4 and the lower flange 2 extended to set on both upper and lower ends of the winding core 1 with a vertical winding axis, two pairs of external electrodes 3*a*, 3*b*, 3*c*, 3*d*, being furnished in the lower flange 2 of the drum-type ferrite core 8, and the windings 5, 6, being wound around the winding core 1 of the drum-type ferrite core 8 and having both ends 5*a*, 5*b*, and 6*a*, 6*b* respectively connected to the external electrodes 3*a*, 3*b*, 3*c*, 3*d* by soldering or thermal press-attaching.

[Patent Literature 1] Laid Open No. 115023/1995

Upon progressing reduction of height in surface-mounting coil components using the conventional drum-type ferrite core, in a type of using the drum-type ferrite core and a sleeve core, the sleeve core is disposed adjoining the circumferences of both flanges of the drum-type ferrite core. Since this type appears similar to the structure of a closed magnetic circuit, although it is advantageous in the coil characteristics (in particular, L: inductance), it is disadvantageous in cost and reduction in height since more number of parts are required.

On the other hand, in the conventional surface-mounting coil component 10 shown in FIG. 6, for realizing reduction in height and concurrently providing the current corresponding coil having a desired inductor characteristic, it is necessary to cover the outer circumference of the winding wound around the winding core between the flanges with the resin coating material with magnetic powder of 60 to 90 wt % in order to secure a necessary capacity of the winding and form an effective magnetic path around the winding.

For producing the surface-mounting coil component of the outside dimension of 1.2 mm or lower using the simplex drum-type ferrite core, the prior art took a technique of bringing a linear expansion coefficient of the drum-type ferrite core and a linear expansion coefficient of resin coating material with magnetic powder to the closer value.

However, in the surface-mounting coil component by the above-mentioned conventional technique, with respect to the flange of the drum-type ferrite core which is 0.35 mm or less in thickness, and has a value of 1.9 or more of a ratio L2/L1 an outer diameter L2 of the upper flange to a diameter L1 of the winding core of the drum-type ferrite core (the flange in the present pertinent surface-mounting coil component, corresponding to such a flange having the maximum overhang size exceeding 1.0 mm in the diameter direction from the outer circumference of the winding core of the upper flange of the drum-type ferrite core), strength of the flange of the drum-type ferrite core could not counterwork the stress arising due to the difference between the linear expansion coefficient of the drum-type ferrite core and the linear expansion coefficient of the resin coating material with magnetic powder in the heat cycle tests (−25° C. to +85° C., 10 cycles, or −40° C. to +85° C., 10 cycles) which is generally required for the parts of portable electronic devices, and the flanges could not avoid inconvenience of cracks occurring.

Further, in the producing process, due to hardening and shrinking of the resin coating material with magnetic powder when filling and hardening this resin on the outer circumference of the winding wound around the winding core between the flanges of the drum-type ferrite core, the flanges also had inconvenience of cracks occurring.

SUMMARY OF THE INVENTION

One aspect of the invention provides a surface-mounting coil component which concurrently realizes low cost, reduction in height, and durability demanded in the heat cycle test.

Another aspect of the invention provides:

(1) surface-mounting coil component, having a drum-type ferrite core composed of the winding core arranged vertically to a mounting surface, an upper flange and a lower flange formed as one body with the winding core on the upper and lower ends thereof, at least one pair of core-directly attached external electrodes being provided on the lower surface of the lower flange of the drum-type ferrite core, and the winding being wound around the winding core and being conductively connected to the external electrodes at both ends, the surface-mounting coil component comprising a resin coating material with magnetic powder which is filled a space between the upper flange and the lower flange of the drum-type ferrite core while covering the winding between the upper flange and the lower flange, wherein the resin coating material with magnetic powder has a glass transition temperature of about −20° C. or lower in a course of transferring from the glass state to the rubber state during changing of shear modulus with respect to temperature as the physical property when hardening.

(2) the surface-mounting coil component as set forth in (1) wherein the glass transition temperature is about −50° C. or lower.

(3) the surface-mounting coil component as set forth in (1) wherein thickness of the upper flange of the drum-type ferrite core is about 0.35 mm or less, wherein a value of a ratio L2/L1 of an outer diameter L2 of the upper flange to a diameter L1 of the winding core of the drum-type ferrite core is about 1.9 or larger.

(4) a method of producing a surface-mounting coil component, comprising:

a step of preparing the drum-type ferrite core where an upper flange and a lower flange are formed as one body, said upper flange being disposed on one end of a winding core with about 0.35 mm or less in thickness, and having a value of about 1.9 or more in a ratio L2/L1 of an outer diameter L2 of the upper flange to a diameter L1 of the winding core of the drum-type ferrite core, and said lower flange being disposed on the other end of the winding core in opposition to said upper flange;

a step of providing core-directly attached external electrodes on the lower surface of the lower flange;

a step of wrapping a winding around the winding core of said drum-type ferrite core, and conductively connecting both ends of the winding to the external electrodes;

a step of filling a paint of a resin coating material with magnetic powder in a space between the upper flange and the lower flange, said upper flange being disposed on the outer circumference of the winding wound around the winding core, being about 0.35 mm or less in thickness, and having a value of about 1.9 or more in a ratio L2/L1 of an outside dimension L2 of the upper flange to a diameter L1 of the winding core of the drum-type ferrite core; and a step of hardening the paint of the resin coating material with magnetic powder;

wherein the step of filling the paint of the resin coating material with magnetic powder uses a paint of the resin coating material with magnetic powder having the glass transition temperature of about −20° C. or lower in the course of transferring from the glass state to the rubber state during changing of shear modulus with respect to temperature as the physical property when hardening.

(5) a method of producing the surface-mounting coil component as set forth in (4), wherein the glass transition temperature is about −50° C. or lower.

The surface-mounting coil component and the production method thereof are constituted as mentioned above, and therefore embodiments of the invention can provide:

(1) the current corresponding coil having a desired inductor characteristic in spite of requiring low cost and low height, (2) the surface-mounting coil component having the resin coating material with magnetic powder filled on the outer circumference of the winding wound around the winding core and in the space between the upper flange and the lower flange, in which the resin coating material with magnetic powder has the glass transition temperature of about −20° C. or lower, more preferably about −50° C. or lower in the course of transferring from the glass state to the rubber state during changing of shear modulus with respect to temperature as the physical property when hardening, whereby the flanges can be prevented from cracking in the heat cycle test, and therefore the surface-mounting coil component are suited to being mounted and served on the board housed inside of the portable electronic machinery being subjected to severe changing in circumstances of serving temperatures, and (3) the surface-mounting coil component having the step of filling the paint of the resin coating material with magnetic powder on the outer circumference of the winding wound around the winding core and in the space range defined between the upper flange and the lower flange in opposition to said upper flange being disposed on the outer circumference of the winding wound around the winding core, being about 0.35 mm or less in thickness, and having a value of about 1.9 or more of the ratio L2/L1 of an outside dimension L2 of the upper flange to the diameter L1 of the winding core of the drum-type ferrite core, and the step of hardening the paint of the resin coating material with magnetic powder, where the step of filling the paint of the resin coating material with magnetic powder uses the paint of the resin coating material with magnetic powder having the glass transition temperature of about −20° C. or lower in the course of transferring from the glass state to the rubber state during changing of shear modulus with respect to temperature as the physical property when hardening, thereby to decrease the thermal stress owing to the expanding and shrinking behavior of the resin generated in the hardening and heating course after coating the resin in the production process and prevent the flanges of the drum-type ferrite core from breakage. Consequently, it is possible to produce the surface-mounting coil component having high reliability to changing in circumstances of serving temperatures at higher yield.

DESCRIPTION OF THE PREFERRED EMBODIMENTS

Explanation will be made on embodiments of the invention, referring to the attached drawings.

Figure 1:
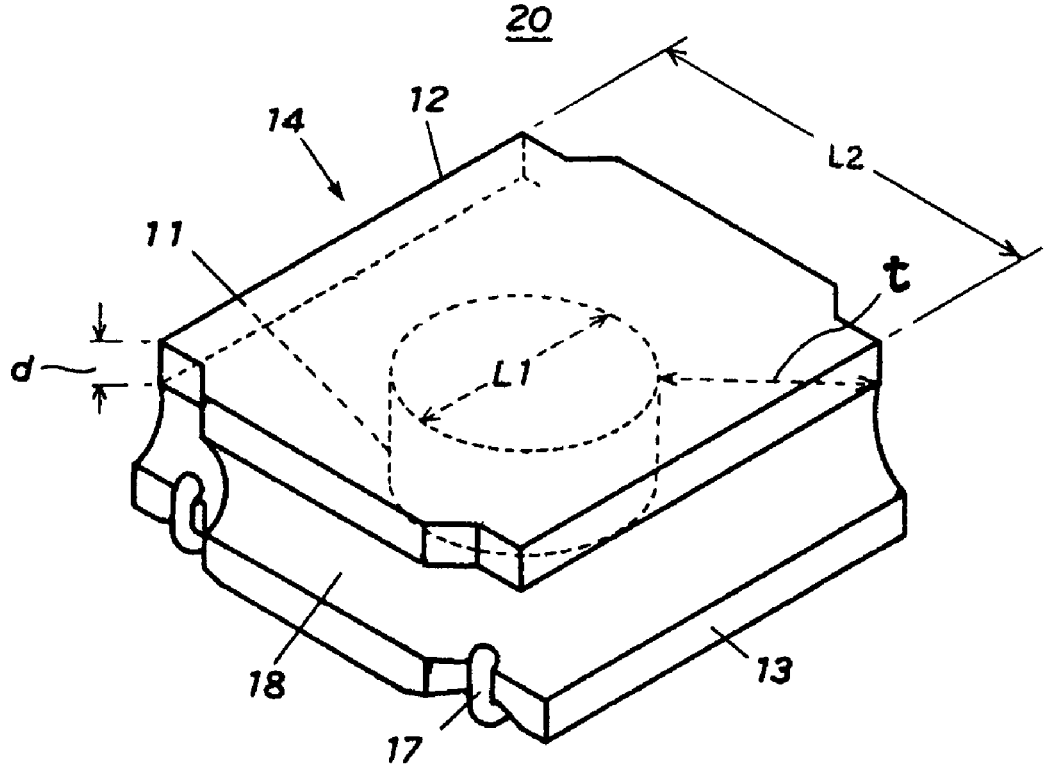
FIG. 1 shows a perspective view seen from the top, showing the structure of the surface-mount choke coil being a typical face-mounting coil parts according to one embodiment of the invention.
Figure 2:
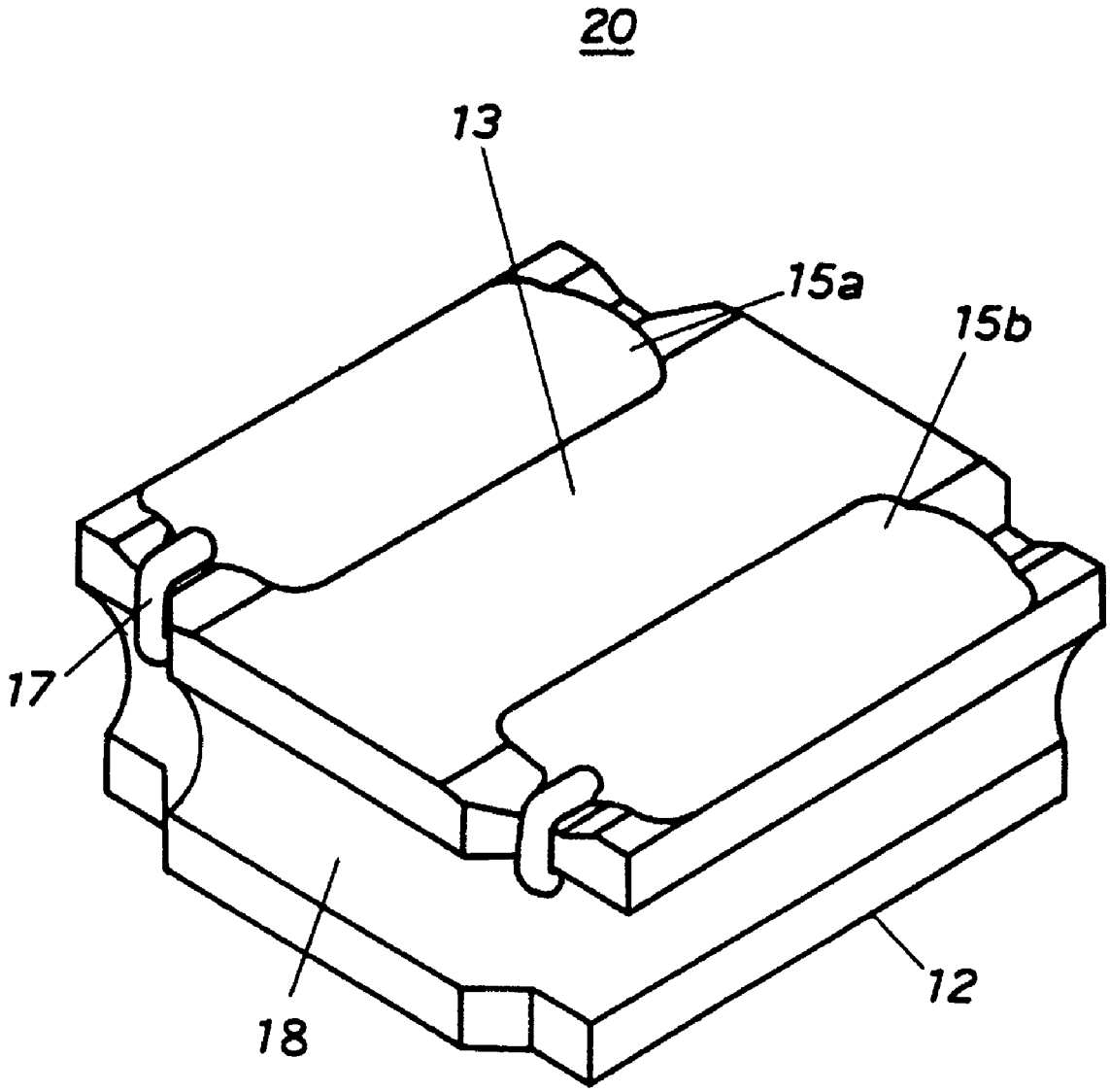
FIG. 2 shows a perspective view seen from the bottom, showing the structure of the surface-mount choke coil according to one embodiment of the invention.
Figure 3:
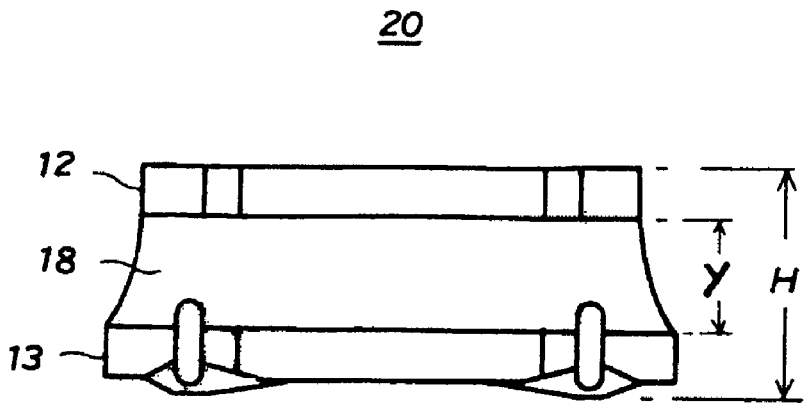
FIG. 3 shows a front view of the surface-mount choke coil according to one embodiment of the invention.
Figure 4:
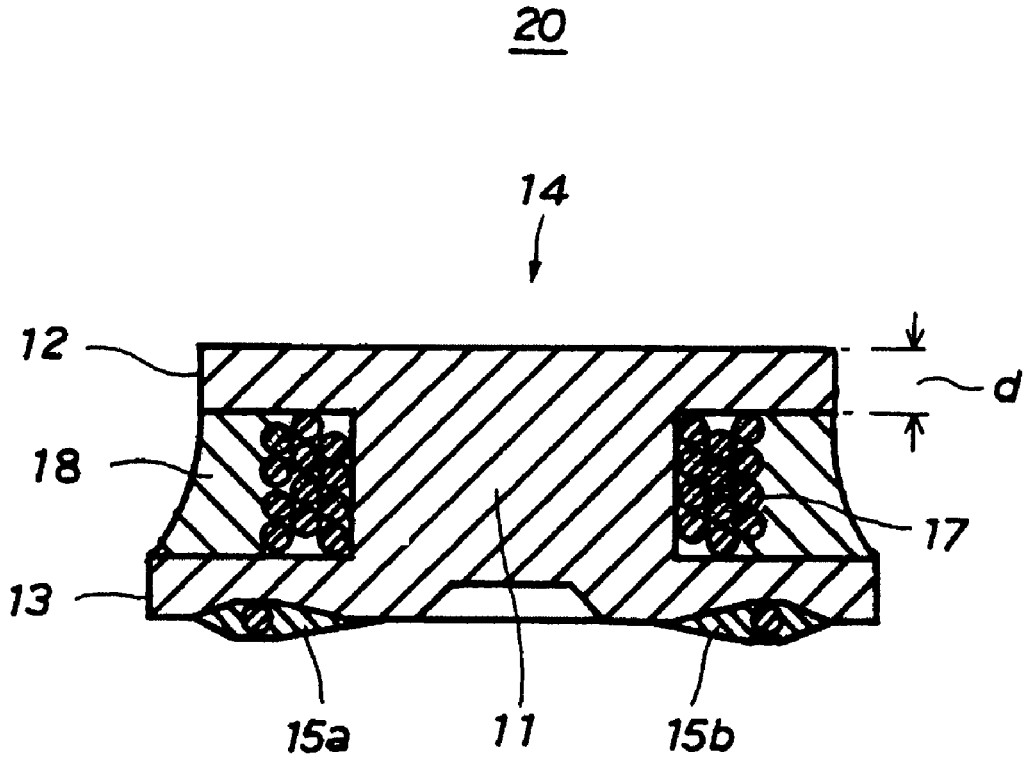
FIG. 4 shows a vertical cross-sectional view of the surface-mount choke coil according to one embodiment of the invention.

FIG. 1 is a perspective view seen from the top showing the structure of the face-mounting choke coil that is a typical surface-mounting coil component according to one embodiment of the invention, FIG. 2 is a perspective view seen from the bottom showing the structure of the face-mounting choke coil according to one embodiment of the invention, FIG. 3 is a front view of the face-mounting choke coil according to one embodiment of the invention, and FIG. 4 is a vertical cross-sectional view of the face-mounting choke coil according to one embodiment of the invention.

In FIGS. 1 to 4, the surface-mounting choke coil 20 has the drum-type ferrite core 14, at least one couple of core-directly attached external electrodes 15*a*, 15*b* provided on the lower surface of the lower flange 13 of the drum-type ferrite core 14, and the winding 17, the drum-type ferrite core being composed of the winding core 11 arranged with the wound axis vertically with respect to the mounting face as well as the upper flange 12 and the lower flange 13 formed as one body with the winding core 11 on the upper and lower ends thereof, and the winding 17 being wound around the winding core 11 of the drum-type ferrite core 14 as well as conductively connected at its both ends to said external electrodes 15*a*, 15*b* by soldering or thermally press-attaching. In particular, the surface mount choke coil 20 has the resin coating material with magnetic powder 18 which is filled the space between the upper flange 12 and the lower flange 13 of the drum-type ferrite core 14, while covering the winding 17 between the upper flange 12 and the lower flange 13. The resin coating material with magnetic powder 18 is characterized by having the glass transition temperature Tg of about −20° C. or lower, more preferably about −50° C. or lower in a course of transferring from the glass state to the rubber state during changing of shear modulus with respect to temperature as the physical property when hardening.

Further, in addition to the above mentioned structure, the surface-mounting choke coil 20 has characteristics that the thickness d of the upper flange 12 of the drum-type ferrite core 14 is about 0.35 mm or less, and the value of the ratio L2/L1 of the outer diameter L2 of the upper flange (in case the flange is circular, its diameter, and in case the flange is rectangular, its longer side) to the diameter L1 of the winding core of the drum-type ferrite core is about 1.9 or more, and as to the present minimum drum-type ferrite core, the maximum overhang size t corresponds to a size of about 1.0 mm or more in the diameter direction from the outer circumference of the winding core 11 of the upper flange 12, and the maximum overhang size t is from the outer circumference of the winding core to the maximum outer diameter of the upper flange.

Limiting the thickness d of the upper flange 12 is advantageous for reducing the height of the surface-mounting coil component (the height H in FIG. 3 is about 1.6 mm or lower). The requirement of the value of about 1.9 or more in the ratio L2/L1 of the outer diameter L2 of the upper flange to the diameter L1 of the winding core, or the requirement of the maximum overhang size t in the diameter direction from the outer circumference of the winding core 11 of the upper flange 12 concerned with present miniaturized drum-type ferrite core, is advantageous for securing a winding capacity necessary for obtaining the choke characteristic with the simplex of the drum-type ferrite core besides restraining the height size H. Incidentally, the lower limit of the thickness d of the upper flange 12 should be reduced soon by development of a processing technique of ferrite material or a baking technique.

The requirement for the resin coating material with magnetic powder 18, that having the glass transition temperature Tg of about −20° C. or lower in a course of transferring from the glass state to the rubber state during changing of shear modulus with respect to temperature as the physical property when hardening, is advantageous for providing an effect of avoiding cracks in the upper flange 12. The requirement is obtained by inventors' intensive studies based on actually measured values of generating conditions of cracking of the upper flange 12 resulted from the heat cycle tests of 50 cycles at −25° C. to +85° C. carried out on the surface-mounting choke coil 20. The requirement for having the temperature of about −50° C. or lower is advantageous for providing an effect of avoiding cracks in the upper flange 12 obtained based on actually measured values of generating conditions of cracking of the upper flange 12 resulted from the heat cycle tests of 50 cycles at −40° C. to +85° C. carried out on the surface-mounting choke coil 20.

Figure 5:
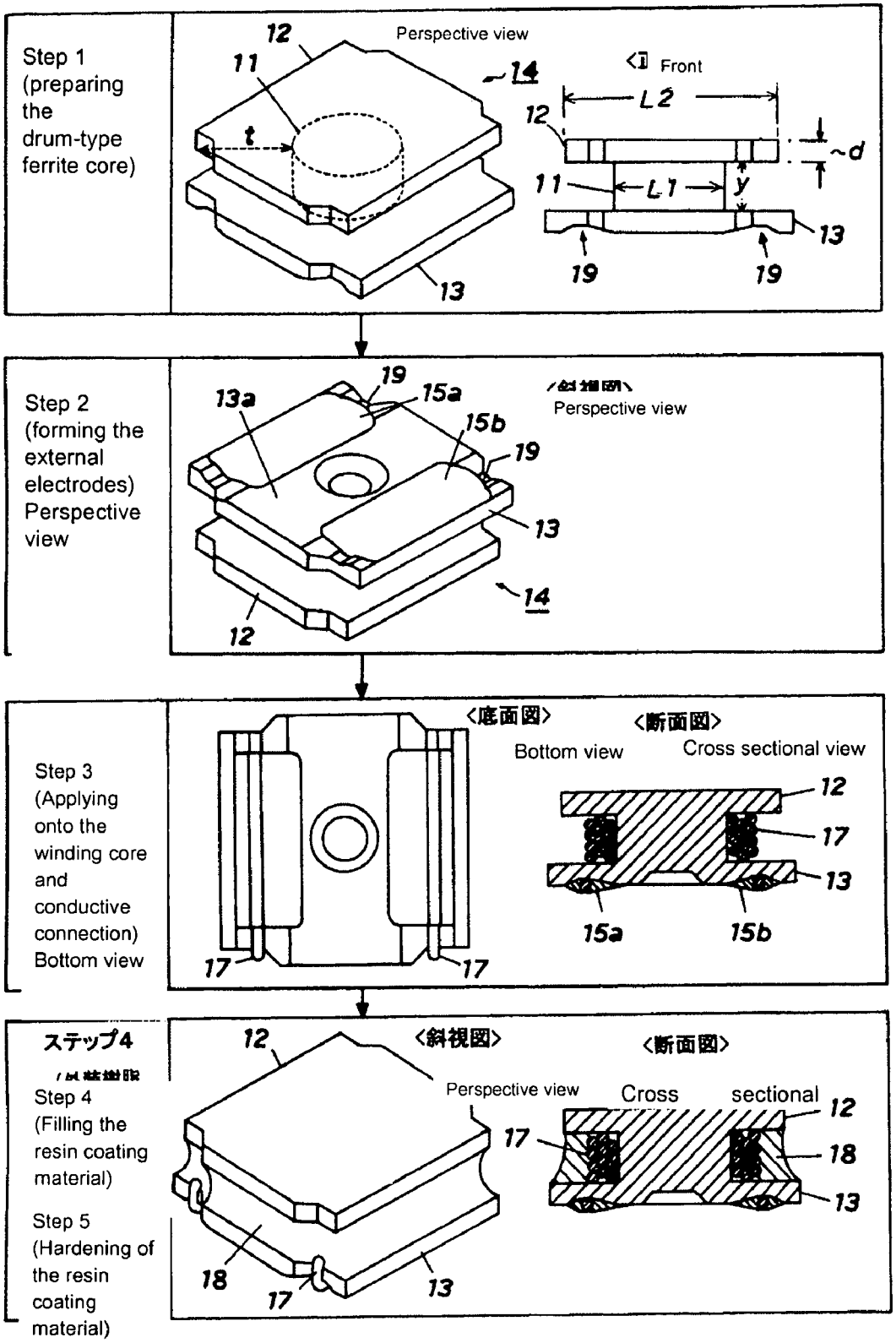
FIG. 5 shows a flow chart diagram for explaining the method of producing the surface-mount choke coil according to one embodiment of the invention.
Figure 6:
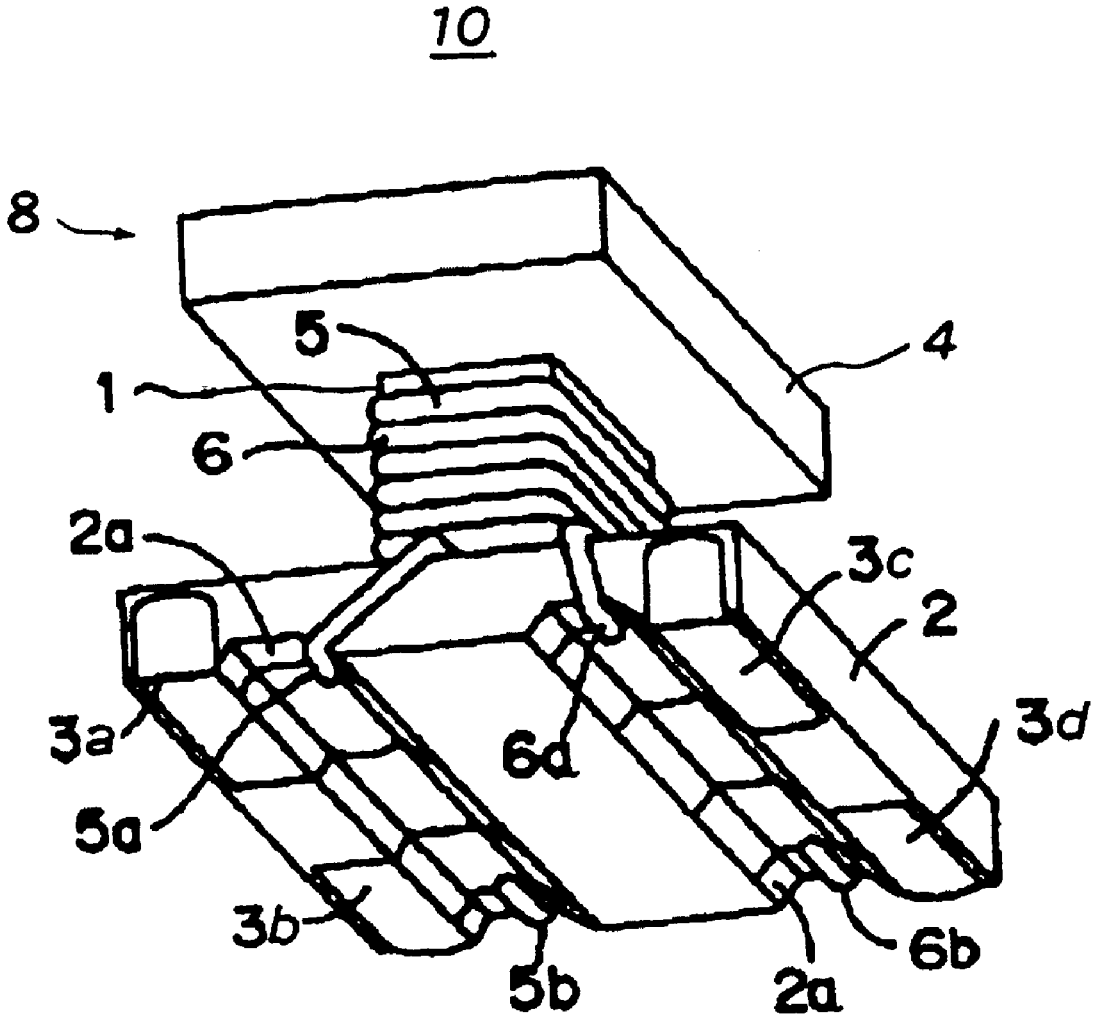
FIG. 6 shows a perspective view seen from the bottom of the conventional surface-mount choke coil.

Next, the method of producing the surface-mounting choke coil 20 as a typical model of the surface-mounting coil component according to one embodiment of the invention has the characteristics of carrying steps 1 to 5 as shown in the flow chart in FIG. 5. In the following description, each of the processes will be explained while adding respective embodiments.

Step 1: A step of preparing the drum-type ferrite core 14, in which the upper flange 12 and the lower flange 13 are formed as one body, the upper flange 12 being disposed on the winding core 11 and on one end of this winding core 11, being about 0.35 mm or less in thickness d, and having the value of about 1.9 or more of the ratio L2/L1 of the outer diameter L2 of the upper flange 12 to the diameter L1 of the winding core of the drum-type ferrite core 14, and the lower flange 13 being disposed on the other end in opposition to the upper flange 12. Specifically, a formed body is produced through a technique of atomizing a slurry containing nickel zinc based ferrite material powders, a binder and a solvent, drying the slurry into pellets, and forming palletized powders into the drum-type ferrite core by use of a dry forming press, or a technique of producing the plate shaped ferrite formed body by the same technique as mentioned above, followed by carrying out the grinding to form the drum-type ferrite core, and this formed body is baked at 1050° C. for two hours to turn out the drum-type baked ferrite core 14. By the way, sizes of the value of L2/L1 of the outside dimension L2 to the diameter L1 of the winding core of the drum-type ferrite core 14 are closely related with occurrence of cracks.

Step 2: A step of providing the core-directly attached external electrodes 15*a*, 15*b* in ranges including winding guide grooves 19 of the lower surface 13*a* of the lower flange 13. Specifically, depending on a screen process printing, the drum-type ferrite core 14 is supported on a printing stage by use of a screen mask having a desired opening pattern, and a paste of Ag electrode material containing Ag conductive powders, glass frit and vehicle is coated by a squeegee, and baked 650° C. for 30 minutes. If needed, Ag baked electrode is performed on the surface with Ni plate and Ti plate, or Cu plate.

Step 3: A step of winding the winding 17 around the winding core 11 of the drum-type ferrite core 14, and conductively connecting both ends of the winding 17 to the external electrodes 15*a*, 15*b*. Specifically, the winding 17 of polyurethane resin covered copper wire having 100 μm diameter is wound 10 turns around the outer circumference of the winding core 11 of the drum-type ferrite core 14, and both ends are respectively bent on along the external electrodes 15*a*, 15*b* of the winding core guide grooves 19. Flux component containing soldering paste is subjected to a stencil printing on the surface of the external electrodes 15*a*, 15*b* so as to cover the end of the winding 17, dried, contacted on the solder surface with a hot plate heated to 300° C., and held for 30 seconds to fuse the solder paste, and to dissolve and remove the polyurethane resin cover, and solder the end of the copper wire and the external electrodes 15*a*, 15*b*. The soldering process may be divided before and after winding of the winding, or the wind of the winding and the soldering may be performed independently.

Step 4: A step of filling the paint 18 of the resin coating material with magnetic powder in the space range defined between the upper flange 12 and the lower flange 13 in opposition to this upper flange 12, the upper flange 12 being disposed on the outer circumference of the winding 17 wound around the winding core 11, being about 0.35 mm or less in thickness, and having the value of about 1.9 or more of the ratio L2/L1 of the outside dimension L2 of the upper flange 12 to the diameter L1 of the winding core 11 of the drum-type ferrite core 14, and this step of filling the paint of the resin coating material with magnetic powder uses the paint of the resin coating material with magnetic powder 18 having the glass transition temperature Tg of about −20° C. or lower, or about −50° C. or lower in the course of transferring from the glass state to the rubber state during changing of shear modulus with respect to temperature as the physical property when hardening. Specifically, the resin coating material with magnetic powder is charged on the outer circumference of the winding i.e., in the space range defined between the upper flange 12 and the lower flange 13, by use of a dispenser and left at room temperature for 30 minutes to dry.

As the resin coating material with magnetic powder 18, such a paint is employed where, for example, epoxy resin and carboxyl modified propylene glycol are mixed at the compositions shown in (Mixture 3) to (Mixture 7) of the glass transition temperature Tg being about −20° C. or lower in the under Table 1 of the resin coating material with magnetic powder and the physical properties after hardening (1), and at the compositions shown in (Mixture 6) or (Mixture 7) of the glass transition temperature Tg being about −50° C. or lower. For reference, (Mixture 1) shows the mixture of the resin coating material with magnetic powder 18 containing as the main component of only epoxy resin generally used in the existing surface-mounting coil components, and (Mixture 2) shows the mixture at 7:3 of epoxy resin and carboxyl group modified propylene glycol. It is seen from Table 1 that the higher is the rate of carboxyl group modified propylene glycol to epoxy resin, the lower is the glass transition temperature Tg under about −20° C. Also it is seen that, from (Mixture 3) to (Mixture 7), in case the glass transition temperature is below about −20° C. (especially lower than about −50° C.), the Young's modulus at the room temperature (20° C.) of the resin coating material with magnetic powder 18 after hardening remarkably goes down in comparison with (Mixture 1) or (Mixture 2), and that the resin coating material with magnetic powder is rich in a property of a soft resin.

TABLE 1

Resin coating material with magnetic powder paint and physical properties after hardening (1)

| | H1 | H2 | H3 | H4 | H5 | H6 | H7 |
|---|---|---|---|---|---|---|---|
| A | 0 | 30 | 40 | 50 | 55 | 60 | 70 |
| B | 100 | 70 | 60 | 50 | 45 | 40 | 30 |
| C | 111 | 111 | 111 | 11 | 111 | 111 | 111 |
| D | 1 | 1 | 1 | 1 | 1 | 1 | 1 |
| E | 5 | 5 | 5 | 5 | 5 | 5 | 5 |
| F | 15 | 15 | 15 | 15 | 15 | 15 | 15 |
| Total | 232 | 232 | 232 | 232 | 232 | 232 | 232 |
| Tg(° C.) | 120 | −10 | −20 | −34 | −40 | −50 | −53 |
| G | 10000 | 3800 | 1500 | 320 | 155 | 37 | 17 |

A: Carboxyl group modified propylene glycol
B: Epoxy resin
C: Ferrite magnetic powder
D: Silica
E: Hardening agent
F: Solvent
G: Young's modulus(Mpa) at 20° C.
H: Mixture As a pertinent example other than the above mentioned resin coating material with magnetic powder 18, (Mixture 8) of adding ferrite magnetic powder of the same weight part to Silicone resin TSE325-B by GE Toshiba Silicone (KK) is shown in the resin coating material with magnetic powder and the physical properties (2) after hardening of Table 2.

TABLE 2

Resin coating material with magnetic powder paint and physical properties after hardening (2)

| | Mixture 8 |
|---|---|
| Silicone resin TSE325-B | 100 |
| Ferrite magnetic powder | 100 |
| Silica | 0 |
| Hardening agent | 0 |
| Solvent | 0 |
| Total | 200 |
| Tg(° C.) | −60 |
| Young's modulus(Mpa) at 20° C. | 0.2 |

As far as satisfying the condition that the resin coating material with magnetic powder 18 has the glass transition temperature of about −20° C. or lower, more preferably about −50° C. or lower in the course of transferring from the glass state to the rubber state during changing of shear modulus with respect to temperature as the physical property when hardening, desirable is such a resin coating material with magnetic powder containing the ferrite magnetic powder of 10 to 90 wt % for improving the inductor characteristic.

Step 5: A step of heating and hardening the paint of the resin coating material with magnetic powder 18. Specifically, the heating treatment is carried out in the heating furnace at 150° C. for 10 minutes.

The paints of the resin coating material with magnetic powder of (Mixture 1) to (Mixture 8) produced by the above mentioned method were used, and the heat cycle tests were carried out, repeating 50 cycles operations of keeping at −40° C. for 30 minutes, followed by keeping at +85° C. for 30 minutes, and again cooling to −40° C. in the heat cycle testing chamber to the respective samples of the surface-mount choke coils (the number n of the samples under the respective conditions=3).

The respective samples have the upper flanges 12 of the outside dimension of 4 mm square; the value of 2.1 in the ratio L2/L1 of the outside dimension L2 to the diameter L1 of the winding core; the size y between the upper and lower flanges of 0.5 mm, and the thicknesses d of the upper flanges of 0.25 mm, 0.30 mm, 0.35 mm, and 0.4 mm. The Table below 3 shows the visually observed results of the cracks occurring in the upper flanges 12 of the respective samples after the tests.

TABLE 3

Heating cycle test(−40~85° C. 50 Cycles) ○: No cracks ●: Cracks

| Thickness of flange (mm) | H1 | H2 | H3 | H4 | H5 | H6 | H7 | H8 |
|---|---|---|---|---|---|---|---|---|
| 0.25 | ●●● | ●●● | ●●● | ●●● | ○●● | ○○● | ○○○ | ○○○ |
| 0.30 | ●●● | ●●● | ●●● | ●●● | ○○● | ○○○ | ○○○ | ○○○ |
| 0.35 | ●●● | ●●● | ●●● | ●●● | ○○○ | ○○○ | ○○○ | ○○○ |
| 0.40 | ○●● | ○○● | ○○○ | ○○○ | ○○○ | ○○○ | ○○○ | ○○○ |

Outer diameter 4 mm square
Outer diameter/axis diameter = 2.1
H: Mixture

The same samples of (Mixture 1) to (Mixture 8) as in Table 3 were carried out with the tests by repeating 50 cycles operations of keeping at −25° C. for 30 minutes, followed by keeping at +85° C. for 30 minutes, and again cooling to −25° C. in the heat cycle testing chamber. The Table 4 below shows the visually observed results of the cracks occurring in the upper flanges 12 of the respective samples after the tests.

TABLE 4

Heating cycle test(−25~85° C. 50 Cycles) ○: No cracks ●: Cracks

| Thickness of flange (mm) | H1 | H2 | H3 | H4 | H5 | H6 | H7 | H8 |
|---|---|---|---|---|---|---|---|---|
| 0.25 | ●●● | ●●● | ○○○ | ○○○ | ○○○ | ○○○ | ○○○ | ○○○ |
| 0.30 | ●●● | ○●● | ○○○ | ○○○ | ○○○ | ○○○ | ○○○ | ○○○ |
| 0.35 | ○●● | ○○○ | ○○○ | ○○○ | ○○○ | ○○○ | ○○○ | ○○○ |
| 0.40 | ○○● | ○○○ | ○○○ | ○○○ | ○○○ | ○○○ | ○○○ | ○○○ |

Outer diameter 4 mm square
Outer diameter/axis diameter = 2.1
H: Mixture

The Table 5 below shows the visually observed results of the cracks occurring in the upper flanges 12 of the respective samples after the heat cycle tests of 50 cycles at −40° C. to +85° C. on the respective samples of (Mixture 1) to (Mixture 8) of the thickness d of the upper flange 12: 0.35 mm, the size y between the upper and lower flanges: 0.5 mm, and the values: 4.00, 2.50, 1.90, and 1.30 in the ratio L2/L1 of the outside dimension L2 to the diameter L1 of the wound flanges 12, wherein the value of 4.00 corresponds to 1.5 mm of the maximum overhang size of the upper flange, the value of 2.50 corresponds to 1.2 mm of the same, 1.90 to 1.0 mm of the same, and 1.30 to 0.5 mm of the same.

TABLE 5

Heating cycle test(−40 to 85° C. 50 Cycles) ○: No cracks ●: Cracks

| I | H1 | H2 | H3 | H4 | H5 | H6 | H7 | H8 |
|---|---|---|---|---|---|---|---|---|
| 4.00 | ●●● | ●●● | ●●● | ●●● | ●●● | ○●● | ○○○ | ○○○ |
| 2.50 | ●●● | ●●● | ●●● | ●●● | ○●● | ○○○ | ○○○ | ○○○ |

TABLE 5-continued

Heating cycle test(−40 to 85° C. 50 Cycles) ○: No cracks ●: Cracks

| I | H1 | H2 | H3 | H4 | H5 | H6 | H7 | H8 |
|---|---|---|---|---|---|---|---|---|
| 1.90 | ●●● | ●●● | ●●● | ●●● | ○○○ | ○○○ | ○○○ | ○○○ |
| 1.30 | ○○○ | ○○○ | ○○○ | ○○○ | ○○○ | ○○○ | ○○○ | ○○○ |

Outer diameter 4 mm square
Thickness of flange 0.35 mm
H: Mixture
I: Outer diameter/axis diameter The same samples of (Mixture 1) to (Mixture 8) as in Table 5 were carried out with the tests of 50 cycles of at −25° C. to +85° C. The Table 6 below shows the visually observed results of the cracks occurring in the upper flanges 12 of the respective samples after the tests.

TABLE 6

Heating cycle test(−25 to 85° C. 50 Cycles) ○: No cracks ●: Cracks

| I | H1 | H2 | H3 | H4 | H5 | H6 | H7 | H8 |
|---|---|---|---|---|---|---|---|---|
| 4.00 | ●●● | ●●● | ○○○ | ○○○ | ○○○ | ○○○ | ○○○ | ○○○ |
| 2.50 | ●●● | ●●● | ○○○ | ○○○ | ○○○ | ○○○ | ○○○ | ○○○ |
| 1.90 | ○●● | ○○○ | ○○○ | ○○○ | ○○○ | ○○○ | ○○○ | ○○○ |
| 1.30 | ○○○ | ○○○ | ○○○ | ○○○ | ○○○ | ○○○ | ○○○ | ○○○ |

Outer diameter 4 mm square
Thickness of flange 0.35 mm
H: Mixture
I: Outer diameter/axis diameter It is seen from Table 4 that in the heat cycle tests of 50 cycles at −25° C. to +85° C., the samples of (Mixture 3) to (Mixture 8) of the glass transition temperature Tg at about −20° C. or lower have no cracks, and in particular, as seen from Table 3, the samples of (Mixture 6) to (Mixture 8) of the glass transition temperature Tg at about −50° C. or lower have scarcely cracks in the heat cycle of 50 cycles at −40° C. to +85° C.

Further, in view of the value of L2/L1 of the outside dimension L2 to the diameter L1 of the winding core 12 of the drum-type ferrite core 14, as seen from Table 6, in regard to the samples of the value of L2/L1 being about 1.9 or more, no cracks occur in all samples of (Mixture 3) to (Mixture 8) of the glass transition temperature Tg at about −20° C. or lower in the heat cycles of 50 cycles at −25° C. to +85° C., and in particular, as seen from Table 5, the samples of (Mixture 6) to (Mixture 8) of the glass transition temperature Tg at about −50° C. or lower have scarcely cracks in the heat cycle of 50 cycles at −40° C. to +85° C.

In the surface-mount choke coil 20 having the above mentioned structure, in view of the results of Table 1 to Table 6, the resin coating material with magnetic powder 18 is charged on the outer circumference of the winding 17 wound around the winding core 11 and in the space range defined between the respective corners of the upper surface of the lower flange 13 and the lower surface of the upper flange 12, and therefore the resin coating material with magnetic powder 18 does not mutually hold the upper flange 12 and the lower flange 13 at large rigidity under the condition of serving temperatures, but has action of relieving stress caused within the core, so to speak as a cushion material. Consequently, it is possible to prevent the upper flange 12 from occurring of cracks in the above mentioned heat cycle test.

By the way, (Mixture 3) to (Mixture 8), in particular (Mixture 6) to (Mixture 8) comparatively lengthen the pot lives after mixing, and are excellent in stability of the processing conditions in case of mass production of the face-mounting coil parts. The Table 7 below shows modified examples of 2-Liquid Type as other modified examples of the resin coating material with magnetic powder having the glass transition temperature of about −50° C. or lower in the course of transferring from the glass state to the rubber state during changing of shear modulus with respect to temperature.

Specifically, it is possible to use Jeffamine D-2000 made by San Techno Chemical Co., Ltd. of 70 wt parts, epoxy resin (Bisphenol A Type) of 30 wt parts, ferrite magnetic powder of 100 wt parts, and the solvent of 20 wt parts. The glass transition temperature Tg of the resin coating material with magnetic powder after hardening is −50° C., but being 2-liquid type, the pot life enabling to coat the dispenser after mixing is about 1 hour, aiming at productions of small amount of many kinds.

TABLE 7

Mixing examples of low Tg (2-Liquid Type)

| | Mixtures |
|---|---|
| Jeffamine D-2000(1) | 70 |
| Epoxy resin (Bisphenol A Type) | 30 |
| Ferrite powder | 100 |
| Solvent | 20 |

San Techno Chemical Co., Ltd.

It is preferable that an area of the upper flange 12 is equal to or smaller than that of the lower flange 13 arranged oppositely corresponding to at least 85%.

Further, it is possible to restrain the height H of the surface-mount choke coil 20 having the above mentioned structure to be about 1.2 mm or lower or about 1.0 mm or lower, and to realize reduction in height than that of the existing surface-mount choke coil (about 1.6 mm or higher).

In regard to the shape of the drum-type ferrite core 14, the winding core 11 may be a circular or square pillar, the upper and lower flanges 12, 13 may be disc, square or rectangular. In addition, the external electrodes 15*a*, 15*b* are enough to dispose at least one couple or two couples on the lower surface 13*a* of the lower flange 13. Neither the position nor the shape is limited.

While the above description has pointed out novel features of the invention is applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are to be embraced within their scope.

What is claimed is:

1. A method of producing a surface-mounting coil component, comprising:

preparing a drum-type ferrite core in which an upper flange and a lower flange are formed as one body, wherein the lower flange is disposed on the other end of the upper flange facing toward the upper flange;

providing external electrodes that are direct-mounted to the core on the bottom surface of the lower flange;

wrapping a winding around the winding core of the drum-type ferrite core and conductively connecting both ends of the winding to the external electrodes;

filling a paint of a resin coating material with magnetic powder in a space range defined between the upper flange and the lower flange in opposition to this upper flange; and hardening the paint of the resin coating material with magnetic powder, wherein the filling of the paint of the resin coating material with magnetic powder uses a paint of the resin coating material with magnetic powder having the glass transition temperature of about −20° C. or lower in the course of transferring from the glass state to the rubber state during changing of shear modulus with respect to temperature as the physical property when hardening.

2. The method of producing the surface-mounting coil component as set forth in claim 1, wherein the glass transition temperature is about −50° C. or lower.

3. The method of producing the surface-mounting coil component as described in claim 2, wherein the paint of the resin coating material with magnetic powder contains magnetic powder, epoxy resin, and carboxyl group modified propylene glycol.

4. The method of producing the surface-mounting coil component as described in claim 2, wherein the paint of the resin coating material with magnetic powder contains magnetic powder and silicone resin.

5. The method of producing the surface-mounting coil component as described in claim 2, wherein the paint of the resin coating material with magnetic powder contains magnetic powder, polyether amine, and epoxy resin.

6. The method of producing the surface-mounting coil component as described in claim 1, wherein the thickness of the upper flange is about 0.35 mm or less.

7. The method of producing the surface-mounting coil component as described in claim 1, wherein a ratio of L2/L1 is about 1.9 or more, where L2 is an outer diameter of the upper flange and L1 is a diameter of the winding core of the drum-type ferrite core.

* * * * *